US008696827B2

(12) United States Patent
Ashrafzadeh et al.

(10) Patent No.: US 8,696,827 B2
(45) Date of Patent: Apr. 15, 2014

(54) DISHWASHER WITH IMAGING DEVICE FOR MEASURING LOAD CHARACTERISTICS AND A METHOD FOR CONTROLLING SAME

(75) Inventors: Farhad Ashrafzadeh, Stevensville, MI (US); Kristopher L. Delgado, Stevensville, MI (US); Sathish A. Sundaram, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 372 days.

(21) Appl. No.: 12/957,663

(22) Filed: Dec. 1, 2010

(65) Prior Publication Data

US 2012/0138092 A1 Jun. 7, 2012

(51) Int. Cl.
*B08B 3/00* (2006.01)

(52) U.S. Cl.
USPC ..... 134/56 D; 134/57 D

(58) Field of Classification Search
USPC ..... 134/56 D
See application file for complete search history.

(56) References Cited

U.S. PATENT DOCUMENTS

| | | | |
|---|---|---|---|
| 5,901,246 A | 5/1999 | Hoffberg et al. | |
| 6,263,888 B1 | 7/2001 | Nomura et al. | |
| 7,200,511 B2 | 4/2007 | Damrath | |
| 7,418,969 B1 | 9/2008 | Crisp, III | |
| 2005/0196046 A1 | 9/2005 | Hudnut et al. | |
| 2007/0181162 A1 | 8/2007 | Classen et al. | |
| 2008/0210272 A1 | 9/2008 | Kaczmarek | |
| 2009/0056754 A1 | 3/2009 | Rolek | |
| 2009/0177032 A1 * | 7/2009 | Garibaldi et al. | 600/109 |

FOREIGN PATENT DOCUMENTS

| | | | |
|---|---|---|---|
| DE | 10048086 | A1 | 11/2002 |
| EP | 1192893 | A2 | 4/2002 |
| JP | 7190929 | A | 7/1995 |
| JP | 8299248 | A | 11/1996 |
| JP | 2003235781 | A | 8/2003 |
| JP | 2004283209 | A | 10/2004 |

OTHER PUBLICATIONS

Bertram et al., Apr. 2002, EP 1192893, English machine translation.*

* cited by examiner

*Primary Examiner* — Michael Barr
*Assistant Examiner* — Jason Ko

(57) ABSTRACT

An automatic dishwasher and a method for controlling the operation of the automatic dishwasher including an imaging device that repeatedly captures images of a sub-portion of a wash chamber as a dish rack is moved from a load position to a use position. The repeated capturing of images is synchronized with the movement of the dish rack, and areas of the dish rack in which dishes are present are determined from the repeatedly captured images.

9 Claims, 10 Drawing Sheets

DISHWASHER WITH IMAGING DEVICE FOR MEASURING LOAD CHARACTERISTICS AND A METHOD FOR CONTROLLING SAME

BACKGROUND OF THE INVENTION

Contemporary automatic dishwashers for use in a typical household include a tub and upper and lower racks or baskets for supporting soiled dishes within the tub. A spray system and a filter system are provided for re-circulating wash liquid throughout the tub to remove soils from the dishes. The dishwasher may have a controller that implements a number of pre-programmed cycles of operation to wash dishes contained in the tub.

SUMMARY OF THE INVENTION

The invention relates to a dishwasher having a wash chamber for receiving dishes for cleaning, a dish rack movable between a load position and a use position, and an imaging device having a field of view encompassing at least a sub-portion of the wash chamber and intersecting the path of travel of the dish rack, and a method of controlling the operation of the dishwasher that includes repeatedly capturing images of a sub-portion of the wash chamber as the dish rack is moved from the load position to the use position, synchronizing the repeated capturing of images with the movement of the dish rack, and determining areas of the dish rack in which dishes are present from the repeatedly captured images.

DESCRIPTION OF EMBODIMENTS OF THE INVENTION

Figure 1:
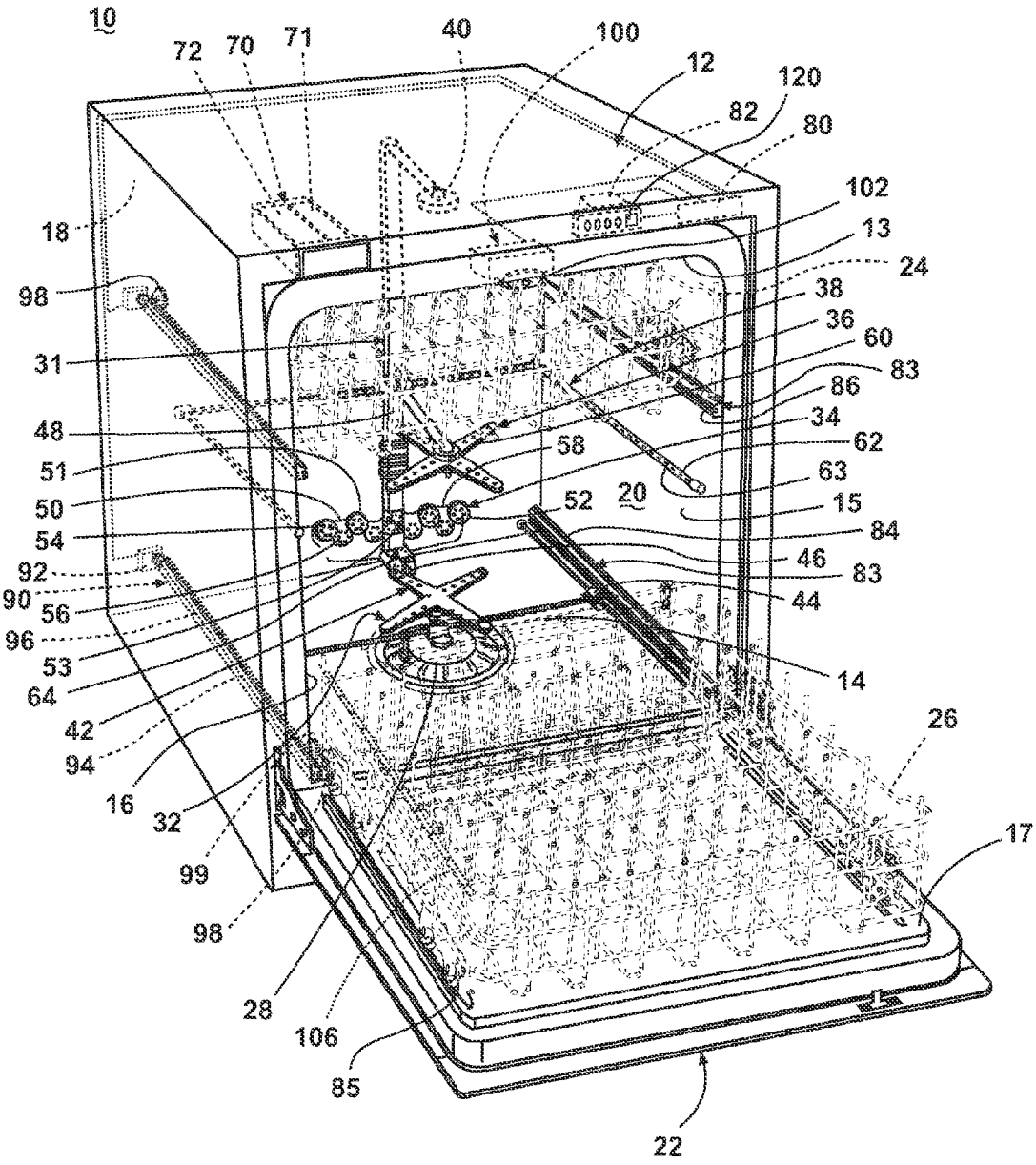
FIG. 1 is a perspective view of a dishwasher according to a first embodiment of the invention.
Figure 2:
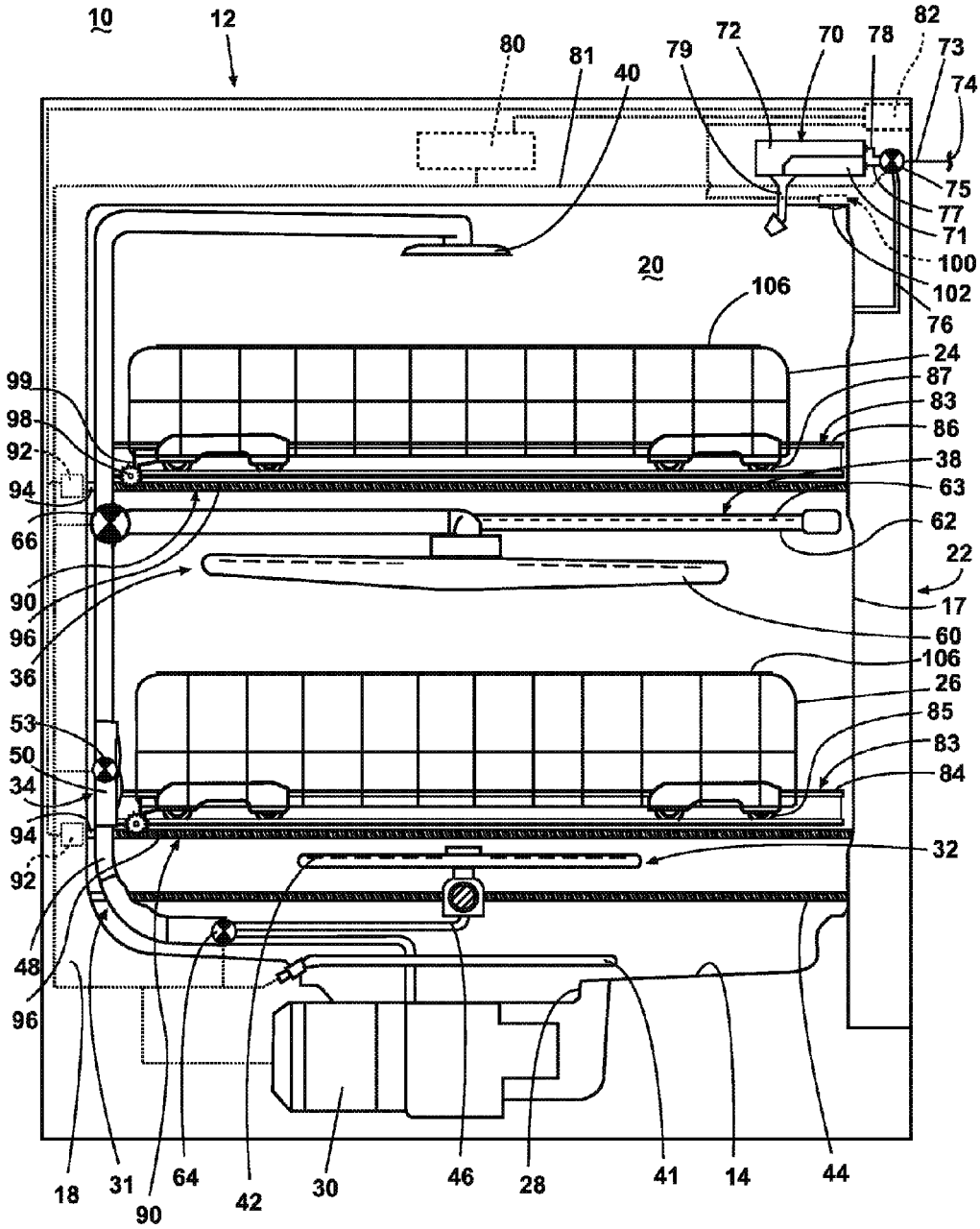
FIG. 2 is a schematic, cross-sectional view of the dishwasher shown in FIG. 1.

Referring to FIGS. 1 and 2, a first embodiment of the invention may be illustrated as a cleaning appliance in the environment of a dishwasher 10. The dishwasher 10 shares many features of a conventional automatic dishwasher, which will not be described in detail herein except as necessary for a complete understanding of the invention. The dishwasher 10 includes a housing 12 having a top wall 13, bottom wall 14, two side walls 15, 16, a front wall 17, and a rear wall 18. The walls 13, 14, 15, 16 and 18 collectively define a wash tub defining a space or wash chamber 20 for washing dishes. As one of skill in the art will appreciate, the front wall 17 may be the interior of a door 22, which may be pivotally attached to the housing 12 for providing access to the wash chamber 20 through a front opening for loading and unloading utensils or other washable items. Utensil holders in the form of upper and lower racks 24, 26, which are located within the wash chamber 20 and receive utensils for washing, have been shown in phantom in FIG. 1 for the sake of clarity. As used in this description, the term utensil may be generic to consumer articles such as dishes and the like that are washed in the dishwasher 10 and expressly includes, dishes, plates, bowls, silverware, glassware, stemware, pots, pans, and the like. While the present invention is described in terms of a conventional dishwashing unit, it could also be implemented in other types of dishwashing units such as in-sink dishwashers or drawer dishwashers.

As illustrated in FIG. 2, the bottom wall 14 of the dishwasher 10 may be sloped to define a lower tub region or sump 28. A pump assembly 30 may be located in or around a portion of the bottom wall 14 and in fluid communication with the sump 28 to draw wash liquid in from the sump 28 and to pump the liquid to a liquid spraying system 31 defining multiple wash zones within the wash chamber 20. The liquid spraying system 31 as illustrated includes several different spray sources, including a first lower spray assembly 32, a second lower spray assembly 34, a first mid-level spray assembly 36, a second mid-level spray assembly 38, and an upper spray assembly 40, all of which may be selectively operated to define multiple wash zones within the wash chamber 20. A heater 41 may be located within the sump 28 for heating the liquid contained in the sump 28. Heater 41 may also be configured to heat air to dry the utensils in the wash chamber 20.

The first lower spray assembly 32 is illustrated as including a rotatable spray arm 42 supported on a movable sprayer carriage 44. Alternatively, a fixed or non-rotatable sprayer may be supported on the movable sprayer carriage 44 and may be configured to deliver a spray of wash liquid in a generally fixed direction, such as vertically upward, without departing from the scope of the invention. Such a spray assembly is set forth in detail in U.S. patent application Ser. No. 11/845,158, filed Aug. 27, 2007, and titled "Dishwasher with Targeted Sensing," which is incorporated herein by reference in its entirety. The movable sprayer carriage 44 according to U.S. patent application Ser. No. 11/845,158 may be configured for selective bi-directional movement to position the sprayer 42 at a selected location in the wash chamber 20. A motor (not illustrated) or other drive mechanism may be operably coupled with the first lower spray assembly 32 to move the sprayer 42 on the sprayer carriage 44.

The sprayer carriage 44 supports the sprayer 42, which may be fluidly coupled through a flexible liquid delivery line 46 and a supply conduit 48 to the pump assembly 30 such that the sprayer 42 may spray liquid for washing and rinsing utensils within the wash chamber 20. The supply conduit 48 extends generally rearward from the pump assembly 30 to the rear wall 18 and extends upwardly to supply wash liquid to the spray assemblies 32-40. The rotating first lower spray assembly 32 may be configured to rotate in the wash chamber 20 and spray a flow of treating liquid in a generally upward direction, over a portion of the interior of the wash chamber 20. The spray from the rotating lower spray assembly 32 may be typically directed to treat utensils located in the lower rack 26.

The second lower spray assembly 34 is illustrated as being located adjacent the lower rack 26 toward the rear of the wash chamber 20. The second lower spray assembly 34 is illustrated as including a vertically oriented spray manifold 50. The spray manifold 50 may not be limited to this position; rather, the spray manifold 50 could be located in virtually any part of the wash chamber 20. Alternatively, the manifold 50 could be positioned underneath the lower rack 26, adjacent or beneath the first lower spray assembly 32. Such a spray manifold is set forth in detail in U.S. Pat. No. 7,594,513, issued Sep. 29, 2009, and titled "Multiple Wash Zone Dishwasher," which is incorporated herein by reference in its entirety. The spray manifold according to U.S. patent application Ser. No. 12/101,302 may be in fluid communication with the wash liquid supply conduit 48 such that wash liquid may be selectively provided to the manifold 50.

As more easily seen in FIG. 1, the manifold 50 may be configured to have two symmetrical opposing halves 51, 52 positioned on opposite sides of the supply conduit 48 with each half 51, 52 being configured to selectively receive wash liquid being pumped through the supply conduit 48. A valve 53 may be provided to selectively divert wash liquid from the supply conduit 48 to each half 51, 52 of the manifold 50. Each half 51, 52 of the manifold 50 may include a plurality of spray nozzles 54 having apertures 56 configured to spray wash liquid into the lower rack 26. The spray nozzles 54 may be fixed or rotatable with respect to the manifold 50. Additionally, each half 51, 52 of the manifold 50 may be configured with one or more passageways 58 to deliver wash liquid from the supply conduit 48 to the apertures 56. The wash liquid being sprayed from the apertures 56 may be under pressure and may thereby create an intensified spray. The second lower spray assembly 34 may be configured to spray a flow of treating liquid from the apertures 56, in a generally lateral direction, over a portion of the interior of the wash chamber 20. The spray from the apertures 56 may be typically directed to treat utensils located in the lower rack 26.

FIG. 2 illustrates that the first mid-level spray assembly 36 may be fluidly coupled with the supply conduit 48 and positioned between the upper rack 24 and the lower rack 26. The first mid-level spray assembly 36 is illustrated as including a spray arm 60 fluidly coupled with the supply conduit 48 and that may be configured to rotate in the dishwasher 10 and spray a flow of wash liquid in a generally upward direction, over a portion of the interior of the wash chamber 20. In this case, the spray from the first mid-level spray assembly 36 may be directed to utensils in the upper utensil rack 24. The first mid-level spray assembly 36 may optionally also provide a liquid spray downwardly onto the lower rack 26, but for purposes of simplification, this will not be illustrated or described herein.

The second mid-level spray assembly 38 is illustrated as one or more spray tubes 62 fluidly coupled with the supply conduit 48 and positioned between the upper rack 24 and the lower rack 26. The second mid-level spray assembly 38 may be mounted on the underside of the upper rack 24, in which case the spray tubes 62 may move into and out of the front of the dishwasher 10 with the upper rack 24. Alternatively, the second mid-level spray assembly 38 may be mounted to any of the walls 15, 16 and 18 that define the wash chamber 20.

The spray tubes 62 may be selectively rotatable and may include a plurality of spray outlets 63 spaced along the spray tubes 62. The spray tubes 62 may be operably coupled with a drive mechanism (not shown) to selectively position the plurality of spray outlets 63. Alternatively, the plurality of spray outlets 63 may be directed generally tangentially in the same direction for causing rotation of the spray tube 62. Thus, the second mid-level spray assembly 38 may be configured to spray a flow of treating liquid from the plurality of spray outlets 63, in a downward, upward, and lateral direction, over a portion of the interior of the wash chamber 20. The spray from second mid-level spray assembly 38 may be directed to treat utensils located in both the upper rack 24 and the lower rack 26. The spray tubes 62 may provide wash liquid to the sides of the upper rack 24 and the lower rack 26 that the other spray assemblies may not reach.

The upper spray assembly 40 is illustrated as being a fixed spray head positioned above the upper rack 24 which may be fluidly coupled with the supply conduit 48. Typically, the upper spray assembly 40 generally directs a spray of wash water in a generally downward direction and helps wash dishes on both the upper and lower racks 24, 26.

Wash liquid may be simultaneously supplied to the spray assemblies 32-40 during operation of the dishwasher 10 so that liquid may be sprayed concurrently by all the spray assemblies 32-40. However, the liquid recirculation system 31 may also include a number of valves including valve 53, valve 64, and valve 66 to selectively control the fluid flow to the spray assemblies 32-40 during operation of the dishwasher 10. As previously described, valve 53 may be provided to selectively divert wash liquid from the supply conduit 48 to the second lower spray assembly 34. Valve 64 may be included to selectively supply wash liquid from the supply conduit 48 to the first lower spray assembly 32. Further, valve 66 may be positioned in the supply conduit 48 and may be operated to selectively control liquid being delivered to the first mid-level spray assembly 36, the second mid-level spray assembly 38, and the upper spray assembly 40. The valves 53, 64, and 66 may be operably coupled with a controller 80 and many different control schemes for the valves 53, 64, and 66 may be provided in response to the cycle and options selected by the user through a user interface 82 operably coupled with the controller 80.

For example, the valve 66 may be controlled to direct all liquid from the supply conduit 48 to the first mid-level spray assembly 36, to the second mid-level spray assembly 38, or to the upper spray assembly 40. The valve 66 may also be controlled to direct a portion of the liquid to each of the first mid-level spray assembly 36, the second mid-level spray assembly 38, and the upper spray assembly 40 to thereby simultaneously spray liquid from each. The valve 66 may also be adjustable to control the amount or ratio of liquid delivered to first mid-level spray assembly 36, the second mid-level spray assembly 38, and the upper spray assembly 40. In this manner, the valve 66 may also be controlled to direct a portion of the liquid to any combination of the spray assemblies 36-40. For example, the valve 66 may be controlled so that spray of liquid from the upper spray assembly 40 may be continuously emitted while the spray of liquid from the first mid-level spray assembly 36, the second mid-level spray assembly 38 are selectively emitted.

Thus, the liquid spraying system 31 may by operated to create zones in the dishwasher 10 by spraying liquid within the wash chamber 20 from the various spray assemblies 32-40. More specifically, the pump assembly 30 draws liquid from the sump 28 and delivers it to one or more of the spray assemblies 32-40 through the supply conduit 48, where the liquid may be sprayed back into the wash chamber 20 through the spray assemblies 32-40 and drains back to the sump 28 where the process may be repeated.

The spray assemblies 32-40 depicted and described herein are for illustrative purposes only, and are not meant to limit the disclosure in any way. It has been contemplated that the spray assemblies 32-40 may be of any structure and configuration. For example, the dishwasher 10 may include other sprayer configurations such as a sprayer assembly movable in a generally vertical plane, a translating wash arm, a discrete nozzle-type sprayer, or an array of wall-mounted nozzle-type sprayers. These may all be individually controllable, or controllable in selected groups, to deliver a spray of wash liquid to selected areas of the wash chamber 20.

A dispensing system 70 may be provided for dispensing treating chemistries, including water, into the wash chamber 20. The dispensing system 70 may be located anywhere within the dishwasher 10 as long as it is positioned to be able to dispense the treating chemistry into the wash chamber 20. The type of dispensing system 70 is not germane to the invention. It may be a single dose dispensing system, a multiple dose dispensing system (i.e., a bulk dispenser), or a combination of both. The dosage may be constant, variable, user-controlled, or automatically controlled. Different types of treating chemistries may be dispensed from the dispensing system 70, e.g. water, detergents, bleach, enzymes, anti-spotting agents, aroma agents, etc. Some of these treating chemistries are deleterious to another treating chemistry's efficacy. An example may be bleach, which is known to destroy certain enzymes found in detergents. As illustrated, the dispensing system 70 may contain multiple cups 71, 72 which may contain different types of treating chemistry to be dispensed to the wash chamber 20 during a wash cycle of the dishwasher 10.

The treating chemistry dispensed from the dispensing system 70 may be mixed with water and applied to the utensils in the wash chamber 20. As illustrated, the dishwasher 10 may further include a conduit 73 coupled with a water supply 74 to fluidly couple the dishwasher 10 to the water supply 74. A valve 75 couples the conduit 73 and water supply 74 with the wash chamber 20 through a supply line 76. The valve 75 also couples the conduit 73 and water supply 74 with the dispensing system 70 through supply lines 77 and 78. Supply lines 77 and 78 lead to cups 71 and 72, respectively, so that treating chemistry in the cups 71 and 72 may be mixed with water from the conduit 73 and dispensed into the wash chamber 20 through a dispensing line 79. Thus, the valve 75 may be used to control the introduction of fresh water from the water supply 74 into the wash chamber 20, or the dispensing system 70. The dispensing line 79 fluidly couples the dispensing system 70 with the wash chamber 20. Thus, fresh water may be delivered from the water supply 74 through the conduit 73, valve 75 and one of two supply lines 77 and 78 into the dispensing system 70 for flushing treating chemistry from one of two cups 71 and 72 through the dispensing line 79 into the wash chamber 20. The valve 75 may be electrically coupled with the controller 80 through a valve control lead 81. The controller 80 may control the operation of the valve 75 in response to the cycle and options selected by the user through the user interface 82.

The dispensing system 70 may be fixed within the housing 12 and have a movable door, hatch, access panel, or other access mechanism (not shown) for access to the dispensing system 70. It has also been contemplated that the dispensing system 70, or a component of the dispensing system 70, may alternatively be carried by the door 22. For example, a separate rinse aid dispenser (not shown) may be located in the door 22 or virtually anywhere within the dishwasher 10. It will be understood that depending on the type of dishwasher and the type of detergent used, the dispensing system 70 and the rinse aid dispenser may be incorporated into one dispensing mechanism.

The liquid spraying system 31 and the dispensing system 70 may differ from the configuration shown in FIGS. 1 and 2, such as by inclusion of other valves, conduits, spray assemblies, treating chemistry dispensers, and the like, to control the flow of liquid through the dishwasher 10 and for the introduction of more than one type of treating chemistry. The dishwasher 10 may further include other conventional components, such as a filter or a steam generator; however, these components are not germane to the present invention and will not be described further herein.

FIG. 2 illustrates more clearly upper and lower racks 24, 26. The upper and lower racks 24, 26 are typically mounted for slidable movement in and out of the wash chamber 20 for ease of loading and unloading. During a wash and rinse portion of a cleaning cycle of the dishwasher 10, the door 22 is in a closed position, and the upper and lower racks 24, 26 are disposed within the wash chamber 20 in a use position, illustrated in FIG. 2, where they are exposed to washing fluid, such as water, and wash aids, such as detergents and rinse aids. When the dishwasher 10 is not operating, the user may move the door 22 to an open position and may move the upper and lower racks 24, 26 from the wash chamber 20 to a load position where at least a portion of the rack resides exteriorly of the housing 12 and where the upper and lower racks 24, 26 may be emptied or filled. The load position is partially illustrated in FIG. 1, which shows the door in the open position and the lower rack 26 in the load position; the upper rack 24 remains in the use position.

More specifically, the upper and lower racks 24, 26 are slidably mounted to the housing 12 by drawer slides 83. For the lower rack 26, the drawer slide 83 may include a pair of rails 84 formed on the side walls 15, 16 in alignment with the inner surface of the door 22 when the door 22 is in the open position such that the lower rack 26 may be moved out of the wash chamber 20 over the door 22. The lower rack 26 may be provided with wheels 85 which roll along the rails 84 and allow the lower rack 26 to be rolled out onto the inner face of the open door 22 and into the load position.

The drawer slide 83 for the upper rack 24 may be slightly more complex and may include a set of rails 86 on which the upper rack 24 may be movably supported and which in turn may be movably supported on the side walls 15, 16. The set of rails 86 may be positioned and journaled for horizontal movement by support rollers (not shown) on the side wall 15, 16. The upper rack 24 has on each side at least two projecting rollers 87 that operably couple with the set of rails 86 and allow the upper rack 24 to slide freely along the set of rails 86. Thus, the upper rack 24 may roll along the set of rails 86 as the set of rails 86 rolls along the supporting rollers (not shown) so that the upper rack 24 may slide far enough with the set of rails 86 to move completely out of the wash chamber 20.

The drawer slides 83 facilitate movement of the upper and lower racks 24, 26 along a path of travel between the use and load positions. The drawer slides 83 are not germane to the invention and will not be described further herein. It should be noted that the drawer slides 83 permit the complete extension of the upper and lower racks 24, 26 beyond the housing 12. It has been contemplated that any other type of drawer slides or any other mechanism suitable for facilitating movement of drawers between the use and load positions may be utilized.

A user may manually move the upper and lower racks 24, 26 to the load position by sliding them along the drawer slides 83. Alternatively, a dish rack mover 90 may be operably coupled to the upper and lower racks 24, 26 to move the upper and lower racks 24, 26 from the load position to the use position in a predetermined manner. The predetermined manner may include the dish rack mover 90 moving the racks 24, 26 in a step-wise manner between the load and use positions. Alternatively, the predetermined manner may include the dish rack mover 90 moving the racks 24, 26 continuously from the load position to the use position. A separate dish rack mover 90 can be provided for each of the upper and lower racks 24, 26 so that each rack 24, 26 may be moved independently of the other.

Since the same dish rack mover 90 may be used for both the upper and lower racks 24, 26, only the dish rack mover 90 for the lower rack 26 will be described, with the understanding that the description also applies to the dish rack mover 90 for the upper rack 24. The dish rack mover 90 may include a drive motor 92, a drive shaft 94, a worm gear assembly 96, a gear 98, and a support carriage 99. The drive shaft 94 may extend along one side wall 15 of the housing 12 and has been illustrated as having the worm gear assembly 96 formed in a portion of the drive shaft 94 along which the gear 98 may be driven. More specifically, the drive shaft 94 operably couples with the drive motor 92 for selective rotation of the drive shaft 94 and the worm gear assembly 96. The gear 98 operably engages the worm gear assembly 96 such that the gear 98 is rotatably driven by the rotation of the drive shaft 94. The gear 98 engages the support carriage 99, which is coupled to the lower rack 26 such that the lower rack 26 moves with the support carriage 99. The gear 98 may be supported in proper alignment on the worm gear assembly 96 by the support carriage 99, which has sufficient strength and durability for the purposes intended. The carriage 99 may also be operably coupled to the lower rack 26 such that the lower rack 26 may move with the gear 98 and support carriage 99.

Thus, the gear 98 moves along the worm gear assembly 96 based on rotation of the drive shaft 94 by the drive motor 92, and the gear 98 pushes or pulls the support carriage 99 relative to the worm gear assembly 96. In turn, the lower rack 26 is also moved along the drawer slide 83 relative to the worm gear assembly 96 based on movement of the support carriage 99. Furthermore, the dish rack mover 90 can be configured such that when a user manually moves the lower rack 26 to the load position, the gear 98 is moved on the worm gear assembly 96 towards the opening of the wash chamber 20 based on the force provided by the user.

It should be noted that the dish rack mover 90 may also be capable of moving the upper and lower racks 24, 26 from the use position to the load position. Although illustrated as having a worm gear assembly 96, the dish rack mover 90 may include any suitable mechanism for transferring the respective rotational motion of the drive shaft 94. Alternative mechanisms may include miter gears, bevel gears, or crossed helical gears. It has also been contemplated that the dish rack mover 90 may take other forms. A non-limiting example may include a length of wire with one end operably coupled with the lower rack 26 and the other end operably coupled to a spool which may in turn be operably coupled with a motor. When a user moves the lower rack 26 to the load position the wire is unwound from the spool based upon the force provided by the user. When the lower rack 26 is to be moved to the use position, the motor may operate to turn the spool and retract the wire onto the spool to draw the lower rack 26 into the wash chamber 20 towards the use position.

As illustrated in FIGS. 1 and 2, an imaging system 100 may be included in the dishwasher 10 and may be operably coupled with the controller 80 to capture images of a portion of at least one of the upper and lower racks 24, 26 as the racks are moved into the wash chamber 20. The imaging system 100 may include one or more imaging device(s) 102 and one or more illumination source(s) (not shown). Exemplary imaging devices 102 may include any optical sensor capable of capturing still or moving images, such as a camera. One suitable type of camera is a CMOS camera. Other exemplary imaging devices include a CCD camera, a digital camera, a video camera, a scanner, or any other type of device capable of capturing an image. The camera may capture visible and/or non-visible radiation. For example, the camera may capture an image using visible light. In another example, the camera may capture an image using non-visible light, such as ultraviolet light. In yet another example, the camera may be a thermal imaging device capable of detecting radiation in the infrared region of the electromagnetic spectrum. The illumination generated by the illumination source may vary, and may well be dependent on the type of imaging device 102. For example, illumination may be infrared if the imaging device 102 is configured to image the infrared spectrum. Similarly, the illumination may be visible light, if the imaging device 102 is configured to image the visible spectrum.

The imaging device 102 may be located in various locations of the dishwasher 10. FIGS. 1 and 2 illustrate the imaging device 102 as being centered in the top wall 13 at the opening of the housing 12. Such a location of the imaging device 102 allows an entire width of one of the upper and lower racks 24, 26 to be in the field of view of the imaging device 102 as the respective rack is moved into and out of the wash chamber 20. Alternatively, the imaging device 102 may be positioned such that the entire or substantially the entire wash chamber 20 may be within the field of view of the imaging device 102. Alternatively, the imaging device 102 may be positioned such that the entirety of or substantially the entirety of the upper and lower racks 24, 26 are within the field of view of the imaging device 102 when they are located within the wash chamber 20.

The embodiment discussed herein will focus on an imaging device 102 positioned such to capture one or more images of at least a portion of at least one of the upper and lower racks 24, 26 as the racks are moved into the wash chamber 20. More specifically, the imaging device 102 may have a field of view that encompasses at least a sub-portion of the wash chamber 20 and intersects the path of travel of the upper and lower racks 24, 26 as they are moved from the load position to the use position. The field of view may be as wide as the upper and lower racks 24, 26 but may be relatively short such that several images need to be captured in order to image the entire length of the racks 24, 26.

Figure 3:
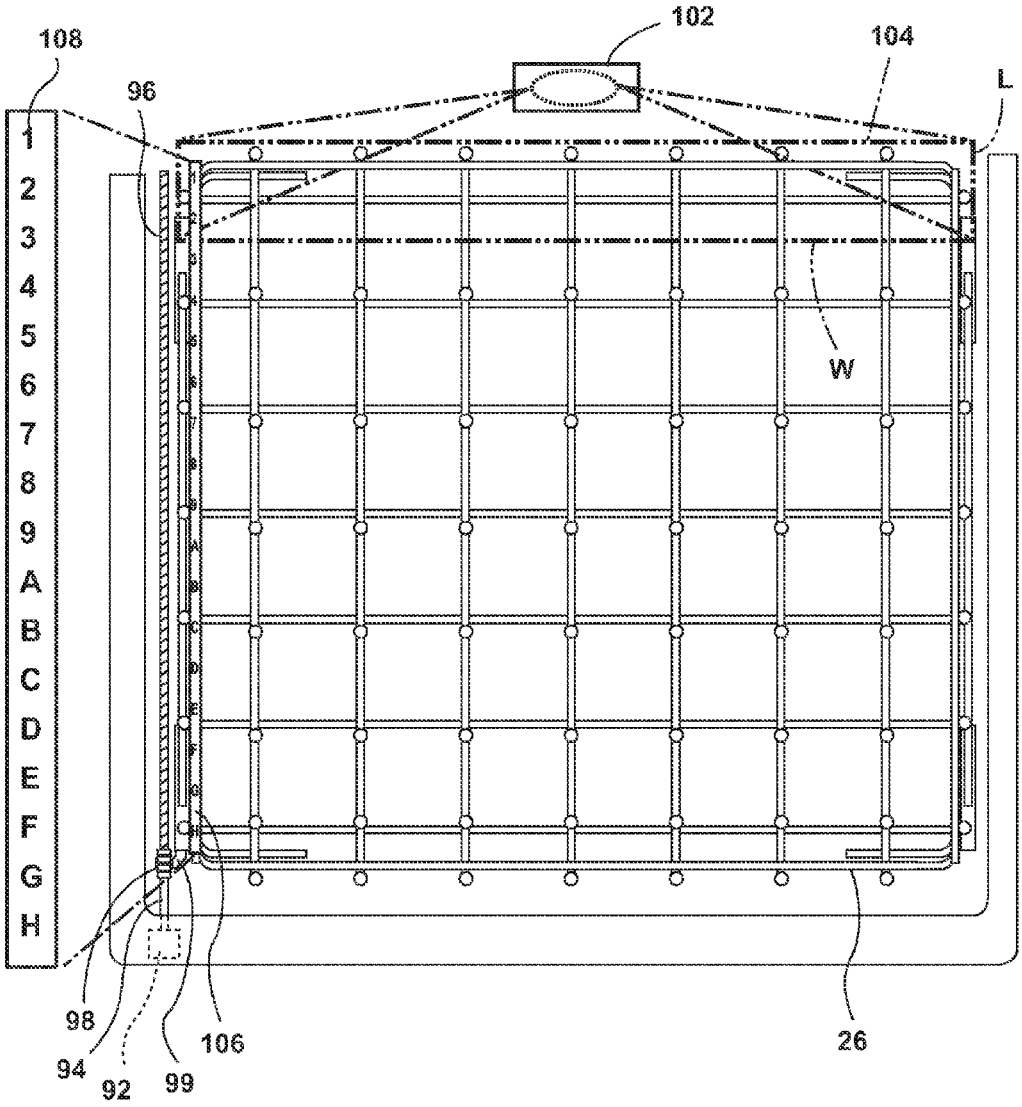
FIG. 3 is a top schematic view of a camera and lower dish rack of the dishwasher shown in FIG. 1.

FIG. 3 is a schematic illustration of such a field of view 104 with respect to the lower rack 26. The field of view 104 is illustrated as having a length L and a width W. A position indicator 106 may be located on one side of the lower rack 26. The position indicator 106 passes through the field of view 104 as the lower rack 26 is moved from the load position to the use position. The position indicator 106 may have a series of indicia or unique markings 108 arranged according to a known positioning pattern to identify what section of the rack 26 is being imaged. The unique markings 108, which have been illustrated as a series of letters (A-H) and numbers (1-9), have been enlarged in FIG. 3 for clarity. As the dishwasher 10 has both upper and lower racks 24, 26 a position indicator 106 may also be located on the upper rack 24 (FIG. 2), and the position indicator 106 for each of the upper rack 24 may be different than the position indicator 106 for the lower rack 26, such that each has a different set of unique markings 108. This allows the controller 80 to determine which images correspond to each rack 24, 26 and to properly reconstruct a single image representative of each rack 24, 26.

Figure 4:
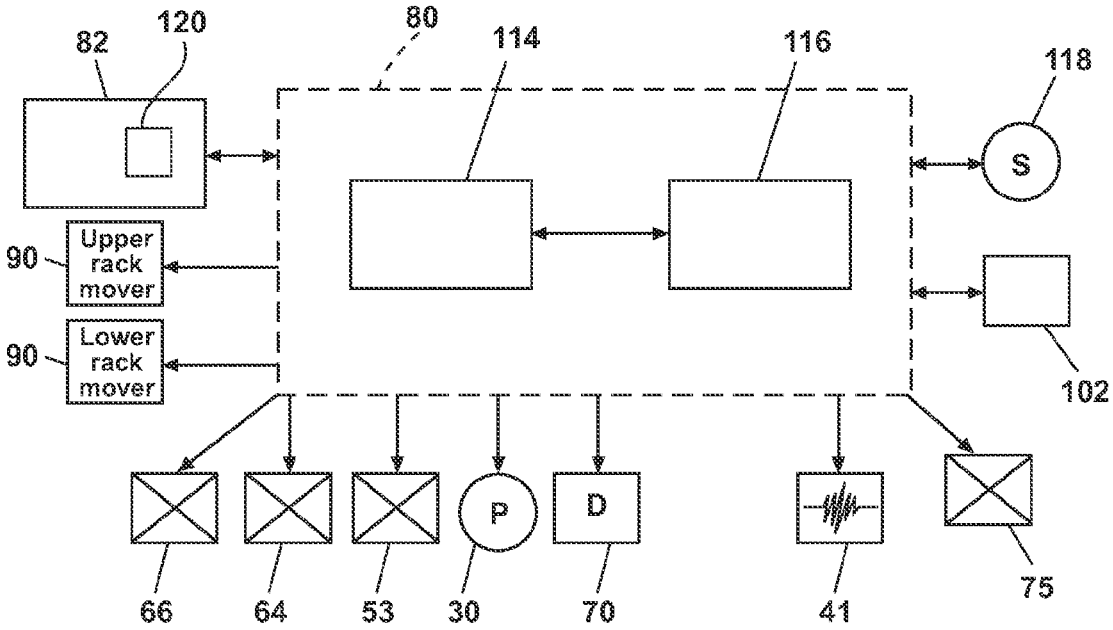
FIG. 4 is a schematic view of a control system of the dishwasher of FIG. 1.

As illustrated in FIG. 4, the controller 80 may be provided with a memory 114 and a central processing unit (CPU) 116. The memory 114 may be used for storing control software that may be executed by the CPU 116 in completing a cycle of operation using the dishwasher 10 and any additional software. For example, the memory 114 may store one or more pre-programmed cycles of operation that may be selected by a user and completed by the dishwasher 10. Non-limiting examples of cleaning cycles include Smart Wash, Pots/Pans, Normal Wash, China/Gentle, Fast Wash, and Quick Rinse. During the Smart Wash cycle, the cleaning level and cycle time may be automatically selected based on a size of the dish load and a soil level of the dish load. The Pots/Pans cycle may be utilized for hard-to-clean and heavily soiled pots, pans, and other dishes. The Normal Wash cycle may be employed for dish loads with a normal amount of food soil. The China/Gentle cycle may be suited for lightly soiled items or china and crystal. The Fast Wash cycle quickly washes dish loads that are pre-rinsed. The Quick Rinse cycle rinses dish loads only, and is typically used for dish loads that will not be washed immediately.

The memory 114 may also be used to store information, such as a database or table, and to store data received from one or more components of the dishwasher 10 that may be communicably coupled with the controller 80. For example, the memory 114 may be used to store images taken by the imaging device 102. Further, the memory 114 may be used for storing image processing software that may be executed by the CPU 116 in completing post-processing of the images taken by the imaging device 102 to form a complete image of one of the upper and lower racks 24, 26. Further, the memory 114 may also include information regarding typical geometries of utensils and typical color, transparency, and/or reflectivity characteristics of various utensils.

The controller 80 may also receive input from one or more sensors 118, which are known in the art and not shown for simplicity. Non-limiting examples of sensors 118 that may be communicably coupled with the controller 80 include a turbidity sensor to determine the soil load associated with a selected grouping of utensils, such as the utensils associated with a particular area of the wash chamber 20 and a sensor for determining a load value at selected locations within the dishwasher 10. The load value may be reflective of a utensil load, i.e. the number and/or size of the utensils in the dishwasher, and/or a soil load, i.e. the quantity of soil on the utensils.

The controller 80 may be operably coupled with one or more components of the dishwasher 10 for communicating with and controlling the operation of the components to complete a cycle of operation. For example, the controller 80 may be coupled with the dish rack mover 90 for each of the upper and lower racks 24, 26 and the imaging device 102 for imaging portions of the upper and lower racks 24, 26 as the upper and lower racks 24, 26 are moved into the wash chamber 20 by the dish rack mover 90. It should be noted that each of the dish rack movers 90 may be operated separately by the controller 80 such that the upper and lower racks 24, 26 may be moved into the wash chamber 20 at different times. Preferably, the dish rack mover 90 first moves the dish rack farthest from the imaging device 102 from the load to the use position, and then moves the other dish rack; in this way, the imaging device 102 will have a clear view of each dish rack. The controller 80 may synchronize the actuation of each dish rack mover 90 and the actuation of the imaging device 102 to capture multiple images of sub-portions of each of the upper and lower racks 24, 26 as they moves from the load to the use position. The controller 80 may use the multiple images to determine the areas of the rack in which dishes are present.

Further, the controller 80 may be coupled with heater 41 for heating the wash liquid during a cycle of operation, components of the liquid spraying system 31 including the pump assembly 30, and valves 53, 64, and 66 for supplying washing liquid to the spray assemblies 32-40, the dispensing system 70, and the valve 75 for dispensing treating chemistry and water to the wash chamber 20 during a cycle of operation. The controller 80 may also be coupled with the user interface 82 for receiving user-selected inputs and communicating information to the user. The user interface 82 may be provided on the dishwasher 10 and operably coupled with the controller 80. The user interface 82 may be provided on the front of the housing 12 as illustrated in FIG. 1, or on the outer panel of the door 22, and may include operational controls such as dials, lights, switches, and displays enabling a user to input commands to the controller 80 and receive information about the selected cleaning cycle and operating parameters. The user interface may also include a load button 120, which a user may press to initiate the movement of the upper and lower racks 24, 26 from the load position to the use position in the wash chamber 20 by the dish rack movers 90.

The previously described dishwasher 10 provides the structure necessary for the implementation of the method of the invention. Several embodiments of the method will now be described in terms of the operation of the dishwasher 10. The embodiments of the method function to automatically determine load characteristics, including the amount, location, and/or type, of utensils loaded into one of the upper and lower racks 24, 26 and to control the operation of the dishwasher 10 based on the determined load characteristics. The load characteristics may be determined by using the imaging device 102 to obtain one or more images over time of the upper and lower racks 24, 26 as the rack travels into the wash chamber 20.

Figure 5:
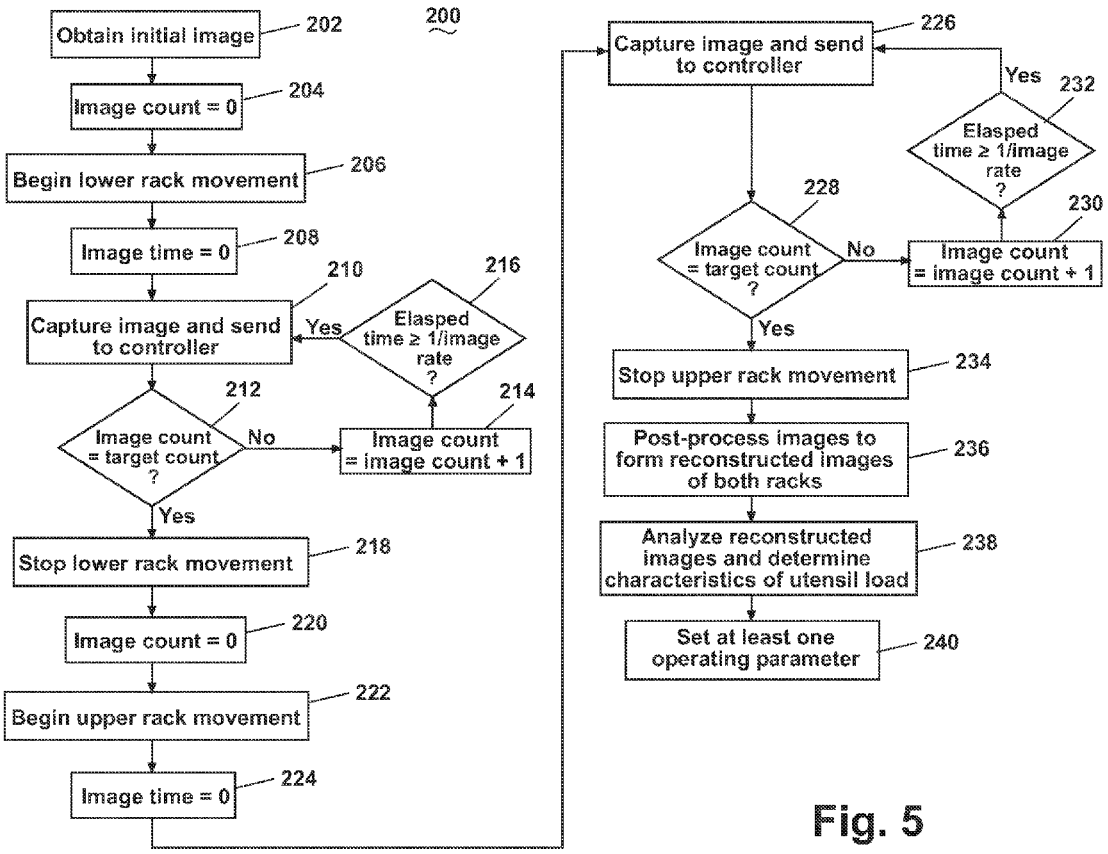
FIG. 5 is a flow chart illustrating a method for operating a dishwasher according to a second embodiment of the invention.

FIG. 5 illustrates a method 200 for controlling the operation of the dishwasher 10 according to a second embodiment of the invention. The sequence of steps depicted is for illustrative purposes only, and is not meant to limit the method 200 in any way as it is understood that the steps may proceed in a different logical order or additional or intervening steps may be included without detracting from the invention. The method 200 assumes that a user has provided the appropriate treating chemistry or chemistries to the dispensing system 70 and that the user has placed a load of utensils within an area of at least one of the upper and lower racks 24, 26 and that the upper and lower racks 24, 26 are in the load position.

The method 200 may be initiated automatically when the user pushes the load button 120 or at the start of a user selected operating cycle. In step 202, an optional initial image may be taken. This initial image may be used as a reference image during post-processing. The initial image may also capture a portion of one of the upper and lower racks 24, 26. At step 204, a counter or image count is set to 0, and movement of rack mover 90 for the lower rack 26 is initiated at 206. The rack mover 90 for the lower rack 26 may move the lower rack 26 from the load position to the use position along a path of travel at a predetermined speed. The predetermined speed may be determined by the controller 80 based on the length of the field of view 104 of the imaging device 102 and the rate at which the imaging device 102 captures images. The predetermined speed may be slow enough to allow the imaging device 102 to capture multiple images of each portion of the lower rack 26. Multiple images of each portion of the lower rack 26 may be beneficial, as duplicate or blurred images may be disregarded during post-processing. At step 208, the image time may be set to 0, and the imaging device 102 may capture an image of some portion of the lower rack 26. The captured image may be sent to the controller 80 at 210.

In the next step 212, the controller 80 determines if the image count equals the target count. The target image count in step 120 may be selected such that a sufficient number of images may be captured to ensure that the entire length of the lower rack 26 is imaged based upon the length of the field of view 104 of the imaging device 102 and the rate at which the imaging device 102 captures images. The image rate may be selected such that a predetermined number of images may be captured within a predetermined amount of time. Thus, the target count of images may be selected to be the amount of images necessary to capture images of the entire lower rack 26. Alternatively, the target count may be some greater number which allows the imaging device 102 to capture multiple images of each portion of the lower rack 26. If the image count is less than the target count, the image count may be increased by 1 in step 214. If the elapsed time in step 216 is determined to be equal to or greater than one divided by the imaging rate, the method returns to step 210 and steps 210 through 212 may be repeated. By basing the image rate and image count on the speed of the rack, the controller 80 may synchronize the repeated capturing of the images with the movement of the lower rack 26.

If it is determined in step 212 that the image count equals the target count, then at step 218 the movement of the lower rack 26 is stopped. At this point, the lower rack 26 should be located entirely in the wash chamber 20 in the use position. At step 220, the counter or image count is set to 0 and movement of rack mover 90 for the upper rack 24 is initiated at 222. The rack mover 90 for the upper rack 24 may move the upper rack 24 from the load position to the use position along a path of travel at a predetermined speed. The predetermined speed may be determined by the controller 80 based on the length of the field of view 104 of the imaging device 102 and the rate at which the imaging device 102 captures images. The predetermined speed may be slow enough to allow the imaging device 102 to capture multiple images of each portion of the upper rack 24. Multiple images of each portion of the upper rack 24 may be beneficial, as duplicate or blurred images may be disregarded during post-processing. At step 224, the image time may be set to 0 and the imaging device 102 may capture an image of some portion of the upper rack 24. The captured image may be sent to the controller 80 at 226.

In the next step 228, the controller 80 determines if the image count equals the target count. The target image count may be selected such that a sufficient number of images may be captured to ensure that the entire length of the upper rack 24 is imaged. Alternatively, the target count may be some greater number which allows the imaging device 102 to capture multiple images of each portion of the upper rack 24. If the image count is less than the target count, the image count may be increased by 1 in step 230. If the elapsed time in step 232 is determined to be equal to or greater than one divided by the imaging rate, the method returns to step 226, and steps 226 through 228 may be repeated.

If it is determined in step 228 that the image count equals the target count, then at step 234 the movement of the upper rack 24 is stopped. At this point, the upper rack 24 should be located entirely in the wash chamber 20 in the use position.

At step 236, the post-processing of the images may begin using software that is stored in the memory 114 of the controller 80. More specifically, during the post-processing step 236, the multiple images taken of the upper and lower racks 24, 26 may be indexed and used to create a reconstructed image that is representative of each of the upper and lower racks 24, 26. After the images have been post-processed by the controller 80, the reconstructed images of the racks 24, 26 may be analyzed at step 238 using software that is stored in the memory 114 of the controller 80. More specifically, the single reconstructed images of each rack 24, 26 may be analyzed using pattern recognition techniques to determine characteristics of the utensil load. For example, pattern recognition may be used to determine if all of the racks or some parts of the racks contain utensils. Alternatively, pattern recognition may be used to determine what types of utensils (i.e. glasses or pans) are contained in the racks or what the utensils are composed of (i.e. glass or metal).

In step 240, the determined load characteristics may be used by the controller 80 to set one or more parameters of a cycle of operation for the dishwasher 10. Controlling the operation of the dishwasher 10 based on the determined load characteristics may include operating or not operating a particular spray assembly 32-40 based on where utensils are located in the upper and lower racks 24, 26, setting at least one parameter of a cycle of operation. Non-limiting examples of parameters which may be set include a type of cleaning cycle, setting a wash water temperature in the wash chamber 20, setting a type of treating chemistry, and setting an amount of treating chemistry.

As a further example, the controller 80 may determine the presence and quantity of utensils in a particular area of the upper and lower racks 24, 26 and the controller 80 may create zones in the dishwasher to correlate to these areas and then auto-select the appropriate cleaning cycle for each zone. That is, based upon the types of dishes located in the dishwasher 10, a zone may be set by the controller 80 and a cleaning cycle may be automatically selected by the controller 80 to optimize the cleaning performance of the dishwasher 10 for a particular load of utensils in each zone. Further, if it is determined that no utensils are located in an area of one of the upper and lower racks 24, 26 then the controller 80 may select that no cleaning cycles are to be run in that portion of the dishwasher 10.

As yet another example, if the type or composition of utensils located in the upper and lower racks 24, 26 is determined in step 238, then the amount or type of chemistry applied is another parameter that may be altered in step 240. More specifically, as a non-limiting example, the controller 80 may determine in step 238 that pots and pans are located in the lower rack 26 and that china is located in the upper rack 24. The user may input at the user interface 82 that the treating chemistry in cup 71 may be dispensed during a Pots/Pans cycle and that the treating chemistry in cup 72 may be dispensed for a China/Gentle cycle. In step 240 the controller 80 may select that a Pots/Pans cycle using the treating chemistry in cup 71 may be run in the lower rack 26 and that a China/Gentle cycle using the treating chemistry in cup 72 may be run in the upper rack 24. The controller 80 may select that the cycles are run sequentially to ensure that the first treating chemistry does not effect the efficacy of the second treating chemistry.

In addition to setting one or more parameters of a cycle of operation based on the determined load characteristics, the controller 80 may also use information received from one or more sensors 118 (FIG. 4). For example, the controller 80 may use information relating to the soil level detected by the sensor 118, and a cleaning cycle may be automatically selected by the controller 80 to optimize the cleaning performance of the dishwasher 10 for the indicated amount of soil and based on the determined load characteristics.

Although the method 200 describes that images are captured for both the upper rack 24 and the lower rack 26 it has been contemplated that images may only be captured for one of the upper and lower racks 24, 26 and that such images may be used to set an operating parameter of a cycle of operation for the dishwasher 10. The method 200 illustrates how the controller 80 may synchronize the repeated capturing of images by moving the dish racks 24, 26 from the load position to the use position in a continuous manner and actuating the imaging device 102 to capture an image at a predetermined interval while the dish racks 24, 26 are moving to capture multiple images of sub-portions of the racks 24, 26. In this manner, the dish rack movers 90 and the controller 80, which is operably coupled to the dish rack movers 90 and the imaging device 102, are means for synchronizing the repeated capturing of images with the movement of the dish racks 24, 26 to capture multiple images of each dish rack 24, 26 as it moves from the load position to the use position.

Figure 6:
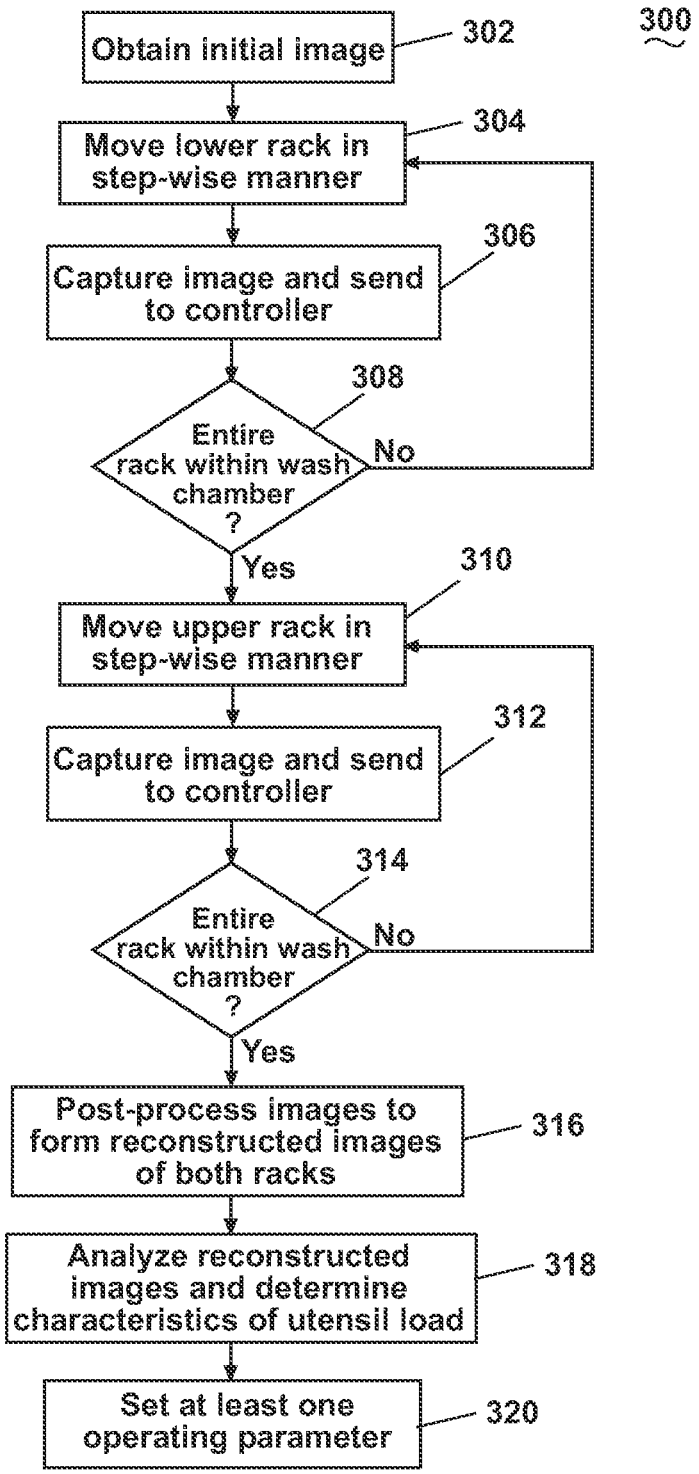
FIG. 6 is a flow chart illustrating a method for operating a dishwasher according to a third embodiment of the invention.

Alternatively, FIG. 6 illustrates a method 300 for operating the dishwasher 10 according to a third embodiment of the invention in which the controller 80 may synchronize the repeated capturing of images when the dish racks 24, 26 are moved from the load position to the use position in a step-wise manner, and an image is captured for every step-wise movement of the racks 24, 26. The sequence of steps depicted for method 300 is for illustrative purposes only, and is not meant to limit the method 300 in any way as it is understood that the steps may proceed in a different logical order or additional or intervening steps may be included without detracting from the invention. The method 300 assumes that a user has provided the appropriate treating chemistry or chemistries to the dispensing system 70 and that the user has placed a load of utensils within an area of at least one of the upper and lower racks 24, 26 and that the upper and lower racks 24, 26 are in the load position.

The method 300 may be initiated automatically when the user pushes the load button 120 or at the start of a user selected operating cycle. In step 302, an optional initial image may be taken. This initial image may be used as a reference image during post-processing. The initial image may also capture a portion of one of the upper and lower racks 24, 26. At step 304, the rack mover 90 moves the lower rack 26 step-wise in a direction from the load position towards the use position along a path of travel. The step-wise manner may include moving the rack in multiple discrete steps, with each step being about equal to a length of the field of view 104 of the imaging device 102 transverse to the path of travel. After the lower rack 26 has been moved one step, the imaging device 102 may capture an image of some portion of the lower rack 26 and the captured image may be sent to the controller 80 at step 306. This results in one image being taken for each portion of the lower rack 26. Thus, the interval between images being captured is equal to the amount of time to move the lower rack 26 one length of the field of view 104 of the imaging device 102. In this manner, the controller 80 may synchronize the repeated capturing of the images with the movement of the lower rack 26 to capture images of the entire lower rack 26.

Alternatively, in step 304 the step-wise manner of moving the lower rack 26 may include moving the rack 26 in multiple discrete steps, with each step being less than a length of the field of view 104 of the imaging device 102 transverse to the path of travel. After the lower rack 26 has been moved one step, the imaging device 102 may capture an image of some portion of the lower rack 26 and the captured image may be sent to the controller 80 at step 306. Thus, the interval between images being captured is about equal to or less than the amount of time to move the lower rack 26 one length of the field of view 104 of the imaging device 102. Moving the lower rack 26 in multiple discrete steps, with each step being less than a length of the field of view 104 of the imaging device 102 allows the imaging device 102 to capture multiple images of each portion of the lower rack 26. Multiple images of each portion of the lower rack 26 may be beneficial as duplicate or blurred images may be disregarded during post-processing.

Regardless of the step-wise manner used to move the lower rack 26, the controller 80 continues to move the lower rack 26 in 304 and take images in step 306 until it is determined in step 308 that the entire lower rack 26 is within the wash chamber 20. At that point the entire lower rack 26 will have been imaged. As a non-limiting example, the controller 80 may use the imaging device 102 as well as the position indicator 106 to determine if the entire lower rack 26 is within the wash chamber 20. Alternatively, a position sensor (not shown) may be provided which detects movement and the location of the lower rack 26 and which communicates such movement and location of lower rack 26 to the controller 80.

If it is determined in step 308 that entire lower rack 26 is within the wash chamber 20, then at step 310, the rack mover 90 moves the upper rack 24 step-wise in a direction from the load position towards the use position along a path of travel. After the upper rack 24 has been moved one step, the imaging device 102 may capture an image of some portion of the upper rack 26 and the captured image may be sent to the controller 80 at step 312. Again, the step-wise manner of moving the upper rack 24 may include moving the rack 24 in multiple discrete steps, with each step being about equal to a length of the field of view 104 of the imaging device 102 transverse to the path of travel or with each step being less than a length of the field of view 104 of the imaging device 102 transverse to the path of travel. Regardless of the step-wise manner used to move the upper rack 24, the controller 80 continues to move the upper rack 24 in 310 and take images in step 312 until it is determined in step 314 that the entire upper rack 24 is within the wash chamber 20. At that point the entire upper rack 24 will have been imaged. As a non-limiting example, the controller 80 may use the imaging device 102 as well as the position indicator 106 to determine if the entire upper rack 24 is within the wash chamber 20. Alternatively, a position sensor (not shown) may be provided which detects movement and the location of the upper rack 24 and which communicates such movement and location of the upper rack 24 to the controller 80.

If it is determined in step 314 that the entire upper rack 24 is within the wash chamber 20, then at step 316 the post-processing of the images may begin using software that may be stored in the memory 114 of the controller 80. More specifically, during the post-processing step, the multiple images taken of the lower rack 26 at 306 may be indexed and used to create a single reconstructed image that may be representative of the lower rack 26, the multiple images taken of the upper rack 24 at 312 may be indexed and used to create a single reconstructed image that may be representative of the upper rack 24. After the images have been post-processed by the controller 80, the single reconstructed images of each of the upper and lower racks 24, 26 may be analyzed at step 318 using software that may be stored in the memory 114 of the controller 80. More specifically, the single reconstructed images of the upper and lower racks 24, 26 may be analyzed using pattern recognition techniques to determine characteristics of the utensil load. For example, pattern recognition may be used to determine if all of the rack 24, 26 or some part of the rack 24, 26 contains utensils. Alternatively, pattern recognition may be used to determine what types of utensils (i.e. glasses or pans) are contained in the racks 24, 26 or what the utensils are composed of (i.e. glass or metal).

In step 320, the determined load characteristics may be used by the controller 80 to set one or more parameters of a cycle of operation for the dishwasher 10. Controlling the operation of the dishwasher 10 based on the determined load characteristics may include operating or not operating a particular wash zone, based on where it has been determined utensils are located in the upper and lower racks 24, 26, setting type of cleaning cycle, setting a wash water temperature in the wash chamber 20, setting a type of treating chemistry, and setting an amount of treating chemistry.

Figure 7:
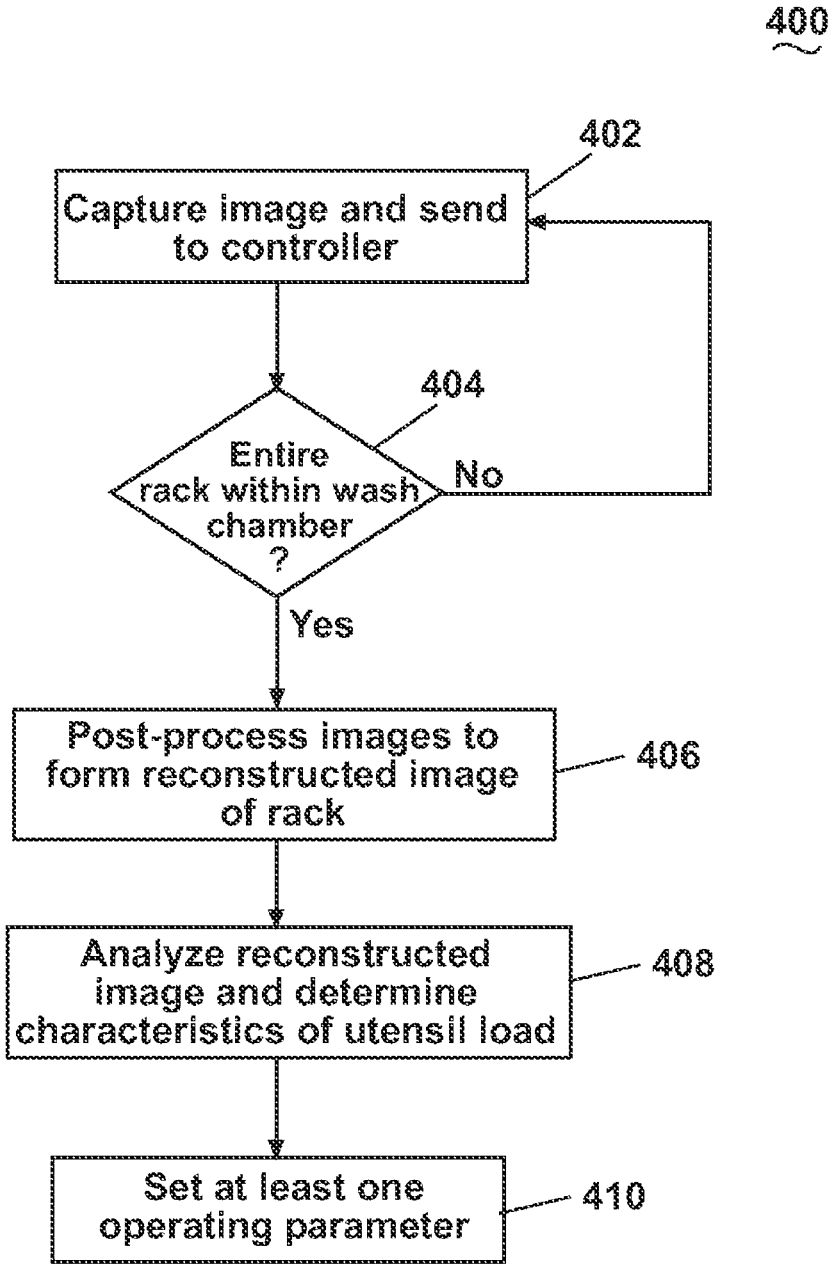
FIG. 7 is a flow chart illustrating a method for operating a dishwasher according to a fourth embodiment of the invention.

Although the dishwasher 10 has been illustrated as having a dish rack mover 90 for each of the dish racks 24, 26, the racks 24, 26 may alternatively be moved to the use position solely based upon force provided by the user. Referring to FIG. 7, a method 400 for operating the dishwasher 10 according to a fourth embodiment of the invention illustrates how the repeated capturing of images may be synchronized with the movement of the dish racks 24, 26 by the user. The sequence of steps depicted for method 400 is for illustrative purposes only, and is not meant to limit the method 400 in any way as it is understood that the steps may proceed in a different logical order or additional or intervening steps may be included without detracting from the invention. The method 400 assumes that a user has provided the appropriate treating chemistry or chemistries to the dispensing system 70 and that the user has placed a load of utensils within an area of at least one of the upper and lower racks 24, 26 and that the upper and lower racks 24, 26 are in the load position. While the method 400 is applicable to either the upper rack 24 or the lower rack 26, the method 400 will be described with respect to lower rack 26 to simplify the description.

The method 400 may be initiated automatically when the user begins to move the lower rack 26 towards the use position. For example, a position sensor (not shown) may be provided which detects movement of the lower rack 26 and which communicates movement to the controller 80 to initiate the method 400. Alternatively, the controller 80 may use the imaging device 102 as well as the position indicator 106 to determine movement of the lower rack 26 so that the controller 80 may initiate the method 400. In step 402, the imaging device 102 captures an image of some portion of the lower rack 26 and the captured image may be sent to the controller 80. In one example, the imaging device 102 associated with method 400 may be a video camera or a camera having an imaging rate capable of capturing one or more images of each portion of the lower rack 26 regardless of the speed at which the user moves the lower rack 26 into the wash chamber 20. In completing step 402, the controller 80 may use the imaging device 102 to determine the presence of the unique markings 108 within the field of view 104 and may actuate the imaging device 102 to capture an image in response to the determined presence of the unique markings 108 or a detected change in the determined presence of the unique markings 108. In this manner, the unique markings 108, the controller 80 using the imaging device 102 to determine the presence of the unique markings 108, and the controller 80 actuating the imaging device 102 to capture an image in response to the determined presence of the unique markings 108, form a means for synchronizing the repeated capturing of images with the movement of the lower rack 26 to capture multiple images of the lower rack 26 as it moves from the load position to the use position.

In step 404 the controller 80 determines if the entire lower rack 26 is within the wash chamber 20. As a non-limiting example, the controller 80 may use the imaging device 102 as well as the position indicator 106 to determine if the entire lower rack 26 is within the wash chamber 20. Alternatively, a position sensor (not shown) may be provided which detects movement and location of the lower rack 26 and which communicates such movement and location of the lower rack 26 to the controller 80. If the entire lower rack 26 is not entirely within the wash chamber 20, then the controller 80 continues to capture images at 402 until it is determined in step 404 that the entire lower rack 26 is within the wash chamber 20. At that point the entire lower rack 26 will have been imaged.

If it is determined in step 404 that the entire lower rack 26 is within the wash chamber 20, then at step 406 the post-processing of the images may begin using software that may be stored in the memory 114 of the controller 80. More specifically, during the post-processing step, the multiple images taken of the lower rack 26 may be indexed and used to create a single reconstructed image that may be representative of the lower rack 26. After the images have been post-processed by the controller 80, the single reconstructed image of the lower rack 26 may be analyzed at step 408 using software that may be stored in the memory 114 of the controller 80. More specifically, the single reconstructed image may be analyzed using pattern recognition techniques to determine characteristics of the utensil load. For example, pattern recognition may be used to determine if all of the lower rack 26 or some part of the lower rack 26 contains utensils. Alternatively, pattern recognition may be used to determine what types of utensils (i.e. glasses or pans) are contained in the lower rack 26 or what the utensils are composed of (i.e. glass or metal).

In step 410, the determined load characteristics may be used by the controller 80 to set one or more parameters of a cycle of operation for the dishwasher 10, as discussed above. The method 400 may be repeated for the upper rack 24.

With respect to the methods 200, 300, and 400, the position indicator 106 may play a role in indexing the captured images. By using the position indicator 106 on the upper and lower racks 24, 26, the controller 80 may first determine if a section of the rack 24, 26 has been captured in an image. More specifically, once the images are captured, the controller 80 may perform an optical character recognition (OCR) for each image to determine which unique markings 108 are present in the image and may store the set of unique markings 108 for each image. The controller 80 may then subsequently identify what sections of the upper and lower racks 24, 26 have been imaged from the stored sets of unique markings 108. The position indicator 106 may further aid in the proper reconstruction of the multiple images into a single image as the controller 80 may determine redundancy of images and misalignment of images based on the position of the unique markings 108.

Figure 8:
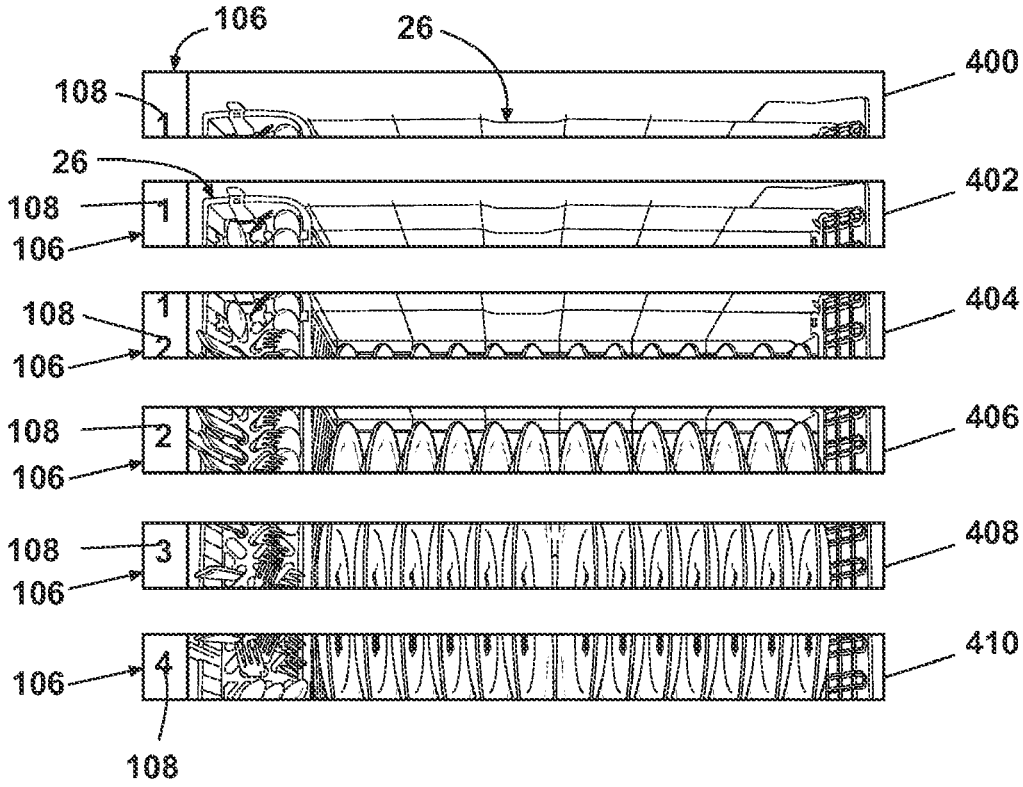
FIG. 8 is a schematic illustration of multiple images captured according to the methods of FIGS. 5-7.
Figure 8A:
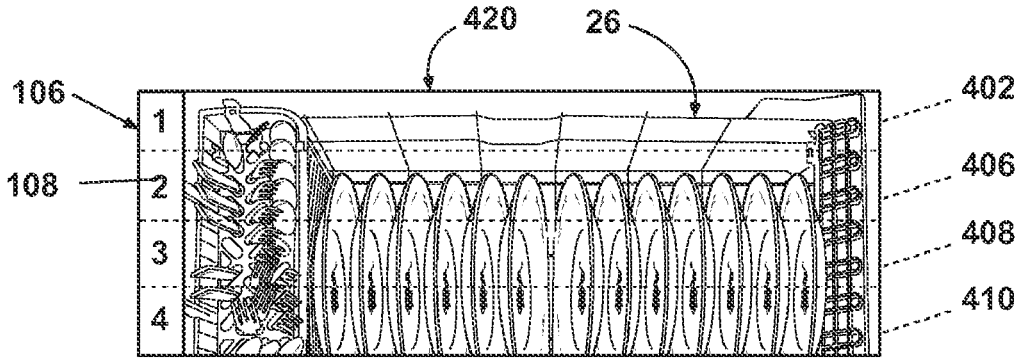
FIG. 8A is a schematic illustration of a reconstructed image formed from the multiple images illustrated in FIG. 8.

FIG. 8 illustrates a plurality of images 400-410 taken by the imaging device 102 as the lower rack 26 was moved into the wash chamber 20. As may be seen in FIG. 8, images 400, 402, 404, and 406 have captured the same general area of the lower rack 26. If the same general area has been imaged multiple times, the image with the best alignment may be selected for use in reconstruction during post-processing by checking the position of the position indicator 106 in the image. In the example shown in FIG. 8, images 402 and 406 have better alignment than images 400 and 404, respectively. Thus, in post-processing, the images 400 and 404 may be discarded, and only images 402, 406, 408, and 410 may be used for reconstructing a single image 420 of the lower rack 26 as illustrated in FIG. 8A.

Figure 9:
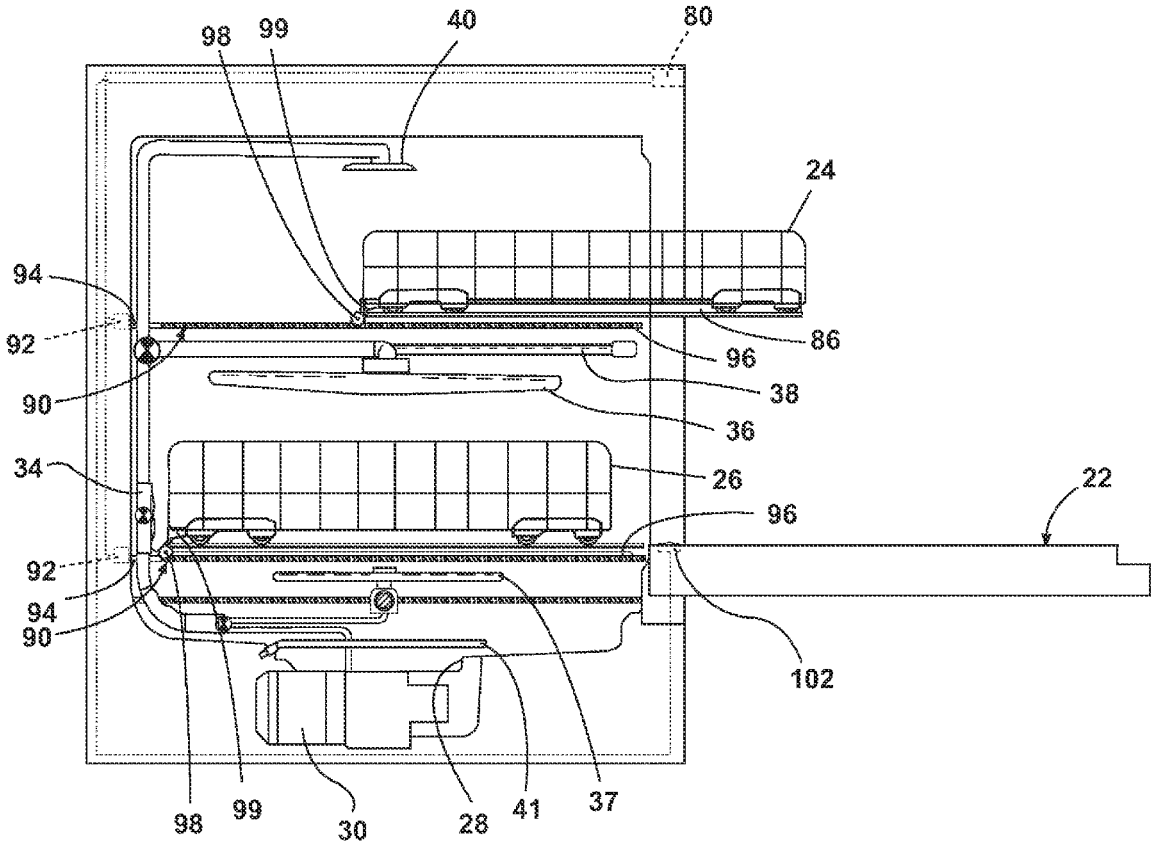
FIG. 9 is a schematic side view of a dishwasher according to a fifth embodiment of the invention, illustrating an alternative location of the camera within the dishwasher.
Figure 10:
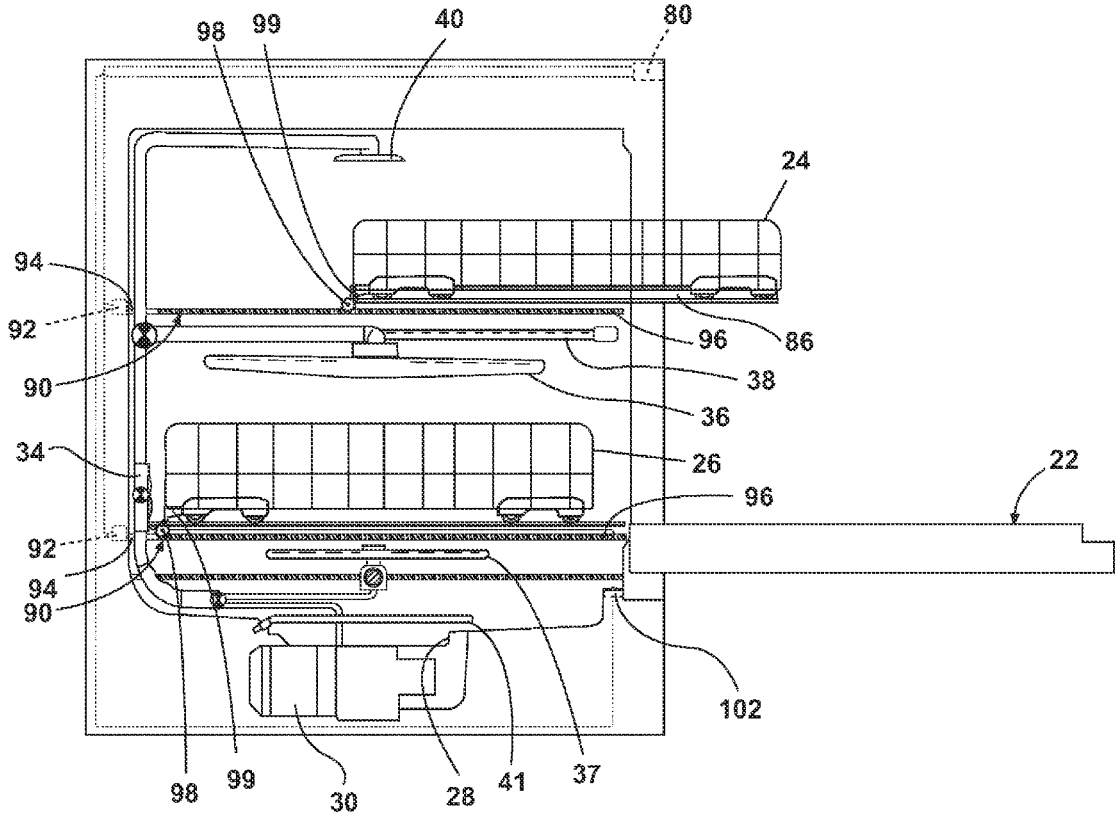
FIG. 10 is a schematic side view of a dishwasher according to a sixth embodiment of the invention, illustrating an alternative location of the camera within the dishwasher.

It may be readily understood that the location of the imaging device 102 may be in numerous other locations depending on the particular structure of the dishwasher 10 and the structure of the upper and lower racks 24, 26. The location of the imaging device 102 may depend on the type of desired image, the area of interest within the upper and lower racks 24, 26 or whether the image is to be captured with the upper and lower racks 24, 26 in motion. There may also be multiple imaging devices, which may image the same or different areas of the upper and lower racks 24, 26. FIGS. 9 and 10 illustrate alternative locations for the imaging device 102. In FIG. 9, the imaging device 102 is provided on an inner surface of the door 22 such that the imaging device 102 is exterior of the wash chamber 20 when in use. In FIG. 10, the imaging device 102 is provided on the bottom wall 14 of the housing 12 such that the imaging device 102 is within the wash chamber 20.

Typical dishwashers do not provide satisfactory control of washing based on load size and dish type. The ability to only select one cycle for a utensil load may result in using wash cycles that may be inappropriate for a portion of the utensil load. For example, a "pots and pans" cycle may be suitable for heavily-soiled cooking utensils, but may be overly hot and long for tableware, thereby contributing to excessive water, detergent, and energy consumption. Furthermore, selection of a cleaning cycle based upon the majority of the utensils in the dishwasher may result in incomplete cleaning of more heavily soiled utensils. The apparatus and methods described above allow the controller 80 to determine characteristics about the utensil load and to select appropriate cleaning cycles and other parameters based on those determined characteristics. In this manner, the dishwasher 10 may provide better washing performance as the dishwasher may increase both efficiency and the cleaning effectiveness of the wash process.

By way of non-limiting example, one characteristic which may be determined is the areas of the dish racks 24, 26 in which utensils are present. This may be useful in order to turn on spray assemblies 32-40 that target the specific area in which utensils are located or to operate the spray assemblies 32-40 in a direction that will ensure proper cleaning. This may also be useful as the controller 80 may define zones within the racks 24, 26 and operate the spray assemblies 32-40 in a manner which may be appropriate for each zone.

Traditional dishwashers normally spray wash liquid uniformly throughout the wash chamber and this may result in wash liquid being sprayed in areas that have no utensils if the dishwasher contains less than a full load of utensils. The apparatus and methods described above allow the controller 80 to determine which portions of the upper and lower racks 24, 26 contain utensils and the controller may then select which spray assemblies 32-40 are to be operated during the cleaning cycle. In this manner, cleaning and resource usage may be optimized due to the spraying of wash liquid only in areas occupied by utensils. This avoids wasted sprays of water and saves both time and energy.

Further, the types of utensils loaded in the racks 24, 26 may be determined by the geometry of the item. Small circles may be interpreted as glasses, while large circles may be interpreted as pans. Small rectangles may be interpreted as plates while large rectangles may be interpreted as backing pans or dishes depending on thickness. Further, trapezoids may be interpreted as bowls. The determined types of utensils may be used by the controller 80 to determine appropriate cycle parameters such as which spray assemblies 32-40 to operate and a time length for a cleaning cycle to be run.

Moreover, the composition of the items loaded in the racks 24, 26 may be determined by the color, transparency, and/or reflectivity of the item. That is, it may be determined if the utensil is ceramic, glass, or metal. This information may then be used to alert the customer if an item should not be placed in the dishwasher 10 because of material incompatibility. This information may also be used to help select parameters such as wash pressure and wash temperatures. Further non-uniformity of these properties could be used to estimate soil levels on the utensils which may then be used to select cleaning cycles of operation.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An automatic dishwasher configured to wash dishes according to a cleaning cycle of operation, the dishwasher comprising:

a housing having an opening;

a wash chamber located within the housing and configured to receive the dishes, with the wash chamber being accessible through the opening;

at least one dish rack movable along a path of travel between a load position, where at least a portion of the at least one dish rack resides exteriorly of the housing, and a use position, where the at least one dish rack resides within the housing and the wash chamber;

a dish rack mover operably coupled to the at least one dish rack to move the at least one dish rack from the load to the use position in a predetermined manner;

an imaging device having a field of view encompassing only a portion of the wash chamber and intersecting the path of travel of the at least one dish rack; and a controller operably coupled to the dish rack mover and the imaging device, and configure to synchronize actuation of the dish rack mover and actuation of the imaging device to capture multiple images of sub-portions of the at least one dish rack as the at least one dish rack moves from the load position to the use position, with the controller configured to use the multiple images to determine areas of the at least one dish rack in which dishes are present;

wherein the at least one dish rack comprises indicia located in the dishwasher such that the indicia pass through the field of view as the at least one dish rack is moved from the load position to the use position, with the controller configured to use the imaging device to determine the presence of the indicia within the field of view and actuate the imaging device to capture an image in response to the determined presence of the indicia.

2. The automatic dishwasher of claim 1 wherein the dish rack mover moves the at least one dish rack in a step-wise manner between the load position and the use position.

3. The automatic dishwasher of claim 2 wherein each step is about equal to a length of the field of view transverse to the path of travel.

4. The automatic dishwasher of claim 2 wherein each step is about equal to or less than a length of the field of view transverse to the path of travel.

5. The automatic dishwasher of claim 1 wherein the dish rack mover continuously moves the at least one dish rack from the load position to the use position.

6. The automatic dishwasher of claim 1 wherein the dish rack mover step-wise moves the at least one dish rack from the load position to the use position.

7. The automatic dishwasher of claim 1 wherein the at least one dish rack comprises two dish racks, which are vertically arranged in the use position, and the dish rack mover first moves the dish rack farthest from the imaging device from the load position to the use position, and then moves the other dish rack from the load position to the use position.

8. An automatic dishwasher configured to wash dishes according to a cleaning cycle of operation, the dishwasher comprising:

a housing having an opening;

a wash chamber located within the housing and configured to receive the dishes, with the wash chamber being accessible through the opening;

at least one dish rack movable along a path of travel between a load position, where at least a portion of the at least one dish rack resides exteriorly of the housing, and a use position, where the at least one dish rack resides within the housing and the wash chamber;

an imaging device having a field of view encompassing only a portion of the wash chamber and intersecting the path of travel of the at least one dish rack; and means for synchronizing the repeated capturing of images by the imaging device with movement of the at least one dish rack to capture multiple images of sub-portions of the at least one dish rack as the at least one dish rack moves from the load position to the use position to create multiple images from which areas of the at least one dish rack in which dishes are present may be determined; wherein the means for synchronizing comprises indicia located in the dishwasher such that the indicia pass through the field of view as the at least one dish rack is moved from the load position to the use position and a controller configured to use the imaging device to determine the presence of the indicia within the field of view and actuate the imaging device to capture an image in response to the determined presence of the indicia.

9. The automatic dishwasher of claim 8 wherein the means for synchronizing comprises a dish rack mover operably coupled to the at least one dish rack to move the at least one dish rack from the load position to the use position in a predetermined manner and a controller operably coupled to the dish rack mover and the imaging device and configured to synchronize actuation of the dish rack mover and actuation of the imaging device, with the controller configured to use the multiple images to determine areas of the at least one dish rack in which dishes are present.

* * * * *